US005237123A

United States Patent [19]

Miller

[11] Patent Number: 5,237,123

[45] Date of Patent: Aug. 17, 1993

[54] VELOCITY, POSITION AND DIRECTION-TRACKING SENSOR FOR MOVING COMPONENTS OF MUSICAL INSTRUMENTS

[75] Inventor: James M. Miller, Tarzana, Calif.

[73] Assignee: Laurence G. Broadmoore, San Fernando, Calif.

[21] Appl. No.: 651,553

[22] Filed: Feb. 6, 1991

[51] Int. Cl.[5] ..... G10F 1/02; G10G 3/04; G10H 1/02; G10H 7/00

[52] U.S. Cl. ..... 84/21; 84/DIG. 7; 84/626; 84/462

[58] Field of Search ..... 84/254, 724, 462, 463, 84/626, 633, 639, 640, 644, 724, DIG. 7, 21, 115

[56] References Cited

U.S. PATENT DOCUMENTS

| | | | |
|---|---|---|---|
| 4,351,221 | 9/1982 | Starnes et al. | 84/462 |
| 4,593,592 | 6/1986 | Stahnke | 84/21 |
| 4,736,662 | 4/1988 | Yamamoto | 84/DIG. 7 |
| 4,913,026 | 4/1990 | Kaneko et al. | 84/462 |
| 5,012,086 | 4/1991 | Barnard | 84/724 |
| 5,022,301 | 6/1991 | Stahnke | 84/626 |

*Primary Examiner*—William M. Shoop, Jr.
*Assistant Examiner*—Helen Kim
*Attorney, Agent, or Firm*—Don J. Flickinger; Jordan M. Meschkow; Robert A. Parsons

[57] ABSTRACT

In order to obtain speed and position information about a moving component of a musical instrument a fin extending in the direction of travel of the moving component is coupled thereto as, for example, by affixing the fin to the hammer shank of a piano. The fin carries indicia, such as a bar code, which can be read, for example, by an optical or magnetic sensor assembly. In one embodiment, a pair of side-by-side indicia bands are carried on the fin with the bands slightly offset in the direction of travel in order that direction, as well as speed and position information can be obtained. The gathered data may include information recorded, for example, for all the notes and the pedals of a piano in order that a performance may be reconstructed and played back employing a solenoid stack or the like.

18 Claims, 5 Drawing Sheets

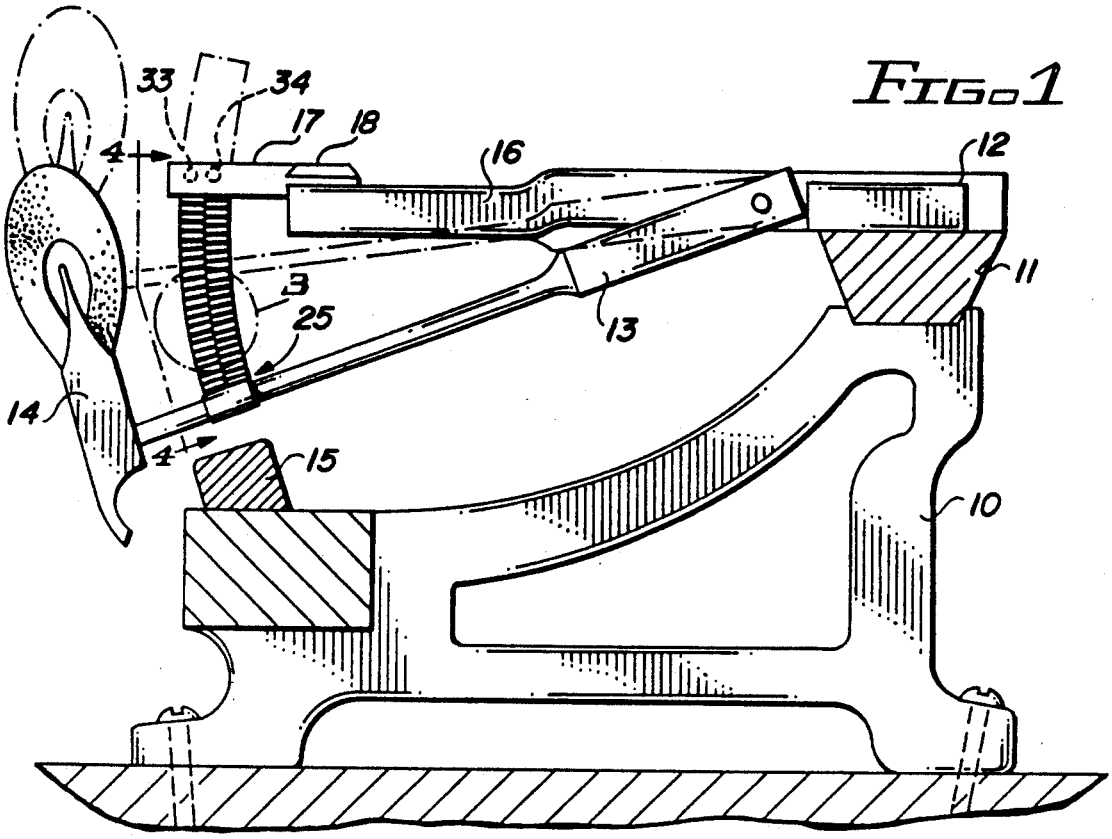
FIG. 1
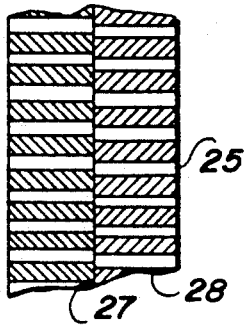
FIG. 3
FIG. 4
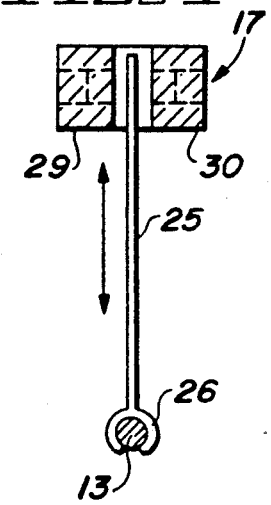

VELOCITY, POSITION AND DIRECTION-TRACKING SENSOR FOR MOVING COMPONENTS OF MUSICAL INSTRUMENTS

FIELD OF THE INVENTION

This invention relates to the art of automatic musical instruments and, more particularly, to a recording system for pianos, player-pianos, reproducing pianos and other musical instruments employing an array of velocity, position and direction-tracking sensors.

BACKGROUND OF THE INVENTION

Ever since the invention of the reproducing piano around the turn of the twentieth century, there have been many attempts to develop a device which could accurately record and reproduce not only the registration of the notes played, but also the dynamics, those subtle gradations of piano volume which make piano performances especially pleasing to the ear. Despite seemingly primitive technologies, many of the types of instruments manufactured in the first half of the twentieth century provided the illusion of remarkable accuracy in their renderings, but the recording process very nearly always involved extensive editing, which sometimes took weeks for a single performance, before a reproducing piano roll record was ready for duplication and distribution. And, of course, the idea of a keyboard instrument recording device for home use was unthinkable, because of the great complexities and costs involved.

In the 1970's, the advent of the Pianocorder TM marked the first time such a home recording unit was offered to the public, but the quality of recording and reproduction was widely regarded as deficient. About the same time, Mr. Wayne L. Stahnke of Santa Monica, Calif. developed a quite accurate piano performance recording device which, however, was too complex and costly to be practical for home use. Mr. Stahnke's system, which was later embodied in very expensive Bösendorfer SE (Stahnke Equipped) pianos, was essentially based on the development work in the mid-to-late 1920's of Clarence N. Hickman, Ph. D. of the American Piano Company laboratories, which used a spark chronograph to sample positions of piano hammers in flight to provide data from which terminal hammer velocity was deduced. This information was later used in attempts to more accurately approximate the striking force of the hammers as originally produced by the pianists who recorded.

Mr. Stahnke's system was an important advancement in the state of the art. Nonetheless, in addition to its great cost, it did have significant technical and practical drawbacks. The system was very invasive to the piano, requiring extensive modification and surgery to the instrument. Optical sensors and shutters, instead of wire contacts, were used to sample hammer motion. This device had the disadvantage of sampling only two points in the hammer's travel, thus introducing the potential for error should the hammer strike twice before descending to the lower shutter position after a blow. Additionally, this arrangement requires careful adjustment so that the hammer sends a digital signal at the correct point in its travel lest the wrong amount energy be sent to the playback solenoid and/or at the wrong time. Therefore, the shutter adjustment must be fastidiously maintained by an expert technician.

A further drawback may be the inability to accurately record certain hitherto unmeasurable tonal characteristics which arise from variations of the pianists' differing approaches towards stroke. It has thus far not been conclusively proved that the terminal velocity of the hammer is the only variable in performance which affects tone. If it is not, the two-point sensor cannot be depended upon to furnish an accurate portrait of the tone produced by a pianist.

The traditional hammer sensors used in this scheme have always been too large to fit between the pinblock and action when removing the latter; also, their circuit boards, which are necessarily taller than the available one-eighth inch, have traditionally contained these sensors. Therefore, the pinblock has had to be cut down in size to accommodate this sensor assembly to permit convenient removal of the piano action for regular action and sensor maintenance.

Further, traditional ways of deducing the point in time at which the string is struck have depended upon assumptions made about time elapsed between the second activation of the optical sensor and the point of strike. These assumptions are highly dependent upon accurate regulation of the sensors and the flags passing through them, a condition extremely difficult to maintain, and are therefore not completely reliable.

As is well known to those skilled in the art, many attempts have been made to record hammer velocity by extrapolating from measurements of the velocity of the piano key. These have never been very satisfactory, since many unpredictable factors govern the relation of the hammer's motion to that of the key.

Another problem with previous schemes is that, as in the Stahnke instruments, graduated pedal motion was measured by means of precision potentiometers for reproduction. These had to be meticulously adjusted to give correct results, and were costly.

Motion of the individual dampers in some schemes has been extrapolated from the motion of the hammer as regards the time the damper lifts, and the moment of its descent has been flagged by a difficult-to-install optical or other switch beneath the keys requiring precise mechanical adjustment for accuracy. Thus, the damper information was merely an assumption.

OBJECTS OF THE INVENTION

Thus, it is a broad object of my invention to provide a new type of musical instrument motion, direction and/or position sensor usable in pianos and other instruments, which replaces the two-aperture non-directionally sensitive sampling method as well as other previous methods with a system capable of generating a partial or complete analog or digital graph or scale corresponding to the velocity curve and direction of motion of the piano hammer or other moving part of any musical instrument, which information may then be used, for example, to reconstruct the force curves of the note and pedal playback solenoids on a reproducing piano.

It is a further object of my invention to provide a means of more accurately recording the exact time of each piano hammer's contact with the string or completion of a key's stroke, etc.

It is a still further object of my invention to provide a musical instrument motion, direction and/or position sensor which is inexpensive, yet more accurate than previous musical instrument motion, direction and/or position sensors.

It is yet another object of my invention to provide a piano motion, direction and/or position sensor which is easy to install as a retrofit in old or existing pianos without modification to the pinblock and with little or no modification to the piano or piano action.

It is still another object of my invention to provide a musical instrument motion, direction and position sensor which is self-calibrating and maintenance free.

Yet another object of my invention is to provide a more accurate means of sensing the motion of piano hammers, dampers, piano and organ keys, violin bows or any other moving part of any musical instrument about whose motion it is desired to accumulate information for any purpose.

Still another object of my invention is to provide a musical instrument motion, direction and/or position sensor which is easier to install, inexpensive and self-calibrating.

An additional object of my invention is to provide a musical instrument motion, direction and/or position sensor suitable for use in gathering data about keyboard or other musical instrument performance which is usable for MIDI and other musical computer languages, yet which is more accurate than those currently available.

A further object of my invention is to provide a musical instrument motion, direction and/or position sensor suitable for use in gathering data about keyboard or other musical instrument performance which is usable for generating data in MIDI and other musical computer languages, yet which is more easily installed than such devices currently available.

SUMMARY OF THE INVENTION

These and other objects of my invention are achieved by a wafer thin optical transducer which is positioned such that it is correctly located to receive a vertical thin strip, or "fin," of material attached to a moving component of a musical instrument, for example, a piano hammer. This strip may contain optical or other information which can be tracked to determine the position and direction of the hammer at any time. By calculating the time taken for the hammer to move from one position to another, its incremental velocity throughout its travel may be determined. If desired, the graph described by the series of positions of the hammer (or other musical instrument part whose motion one wishes to measure) during a stroke may be used to develop a similar or related force curve for, for example, a playback solenoid.

Alternatively, the frequency with which the optical or magnetic sensor is activated by regularly spaced (opaque or translucent) bars on the fin attached to the piano hammer at any point in the hammer's travel, may be read as an analog frequency and interpreted as a relative value corresponding to velocity of the hammer. This information may be sampled at any point in the hammer's travel, but that taken at the moment of the hammer's contact with the string is especially useful. The change of phase resulting from the difference in the sequence of bars in the dual scales read before and after this point of contact with the string, or the momentary cessation of information as the hammer changes direction, may flag the software to take a frequency (velocity) and position reading. In this way a velocity value may be obtained at a single point in travel instead of calculating the speed between two points, and this method also allows information about terminal velocity to be obtained at a point much closer to, or at the moment of actual contact with the string. Further, whenever the point of contact with the string is self-flagging, it will always be consistent throughout the piano regardless of regulation, therefore no calibration is ever necessary to preserve accuracy. At least in the case of a piano hammer, it is also possible to determine the point of reversal of direction and therefore of impact, by means of comparative analysis of the wave form detected by a single sensor using a fin with a single scale of the above-mentioned pattern, since the hammer markedly slows down at the point of impact. If the point at which this slowdown occurs is clearly enough discerned, all of the same data yielded by the dual-sensor method may be accurately determined by the single-sensor method, except for reversals of direction which do not occur at a point of impact. It is to be emphasized that it is the ability of a sensor to achieve accurate perception of the point of strike, or reversal of direction of the part whose motion is being monitored which makes superior accuracy of data, and self-calibration, possible.

Preferably, there is carried on the "fin" a step code of evenly spaced bars of 100% contrasts, detected and determined by logic for the three informational requirements: viz.: the velocity of the hammer (or other musical instrument part being analyzed) at any point between rest and strike, the stop position at strike, check, unchecked repetition lift, rest or any other possible point in between, as well as instantaneous changes in the direction of movement. By this means, a fine resolution can be obtained with an inexpensive device, yet provide absolutely reliable information. Although it is possible to obtain satisfactory results under most conditions using a single row of bars, by using two staggered adjacent vertical rows of bars (in the special configuration to be disclosed) read by dual photosensors, the number of available discrete steps is doubled, and also direction can be determined at any point in travel without needing to count all bars traversed by the sensor and extrapolate the point of reversal from this number.

This enables the use of an easily software-calibrated arrangement using a partial coded flag (only in the final segments of the hammer's travel) to learn its velocity, without the possibility of errors arising due to double-striking of the hammer before its complete descent, an event which can cause confusion in a non directionally-sensitive information gathering scheme. Another way of flagging the point of strike or reversal is to position a microphone so as to send a digital signal to the software at the instant of each note's strike during calibration, and the number of segments read on the upswing thereby noted by the system at the instant of the hammer's contact with the string. This number provides precise information about the time at which each note is struck, and by activating a clock at the time of the sensor's alignment with any selected previous bar (i.e., the first bar in the partial flag), velocity is deduced from the time required for the hammer to reach the string from the instant of this previous event.

When used in a grand piano, my optical (or other type of) sensor is thin enough that, in most cases, when its height is adjusted correctly, it just misses scraping the underside of the lowest usual piano pinblock when the action to which it is mounted is withdrawn from the piano (should there, however, be a clearance problem, my special adjustable design of supporting bracket for the sensor rails will readily allow the sensor rail or rails to be lowered below the level of the pinblock while the action is being withdrawn from or inserted in the action cavity.)

The sensor case may incorporate a simple spring-clip which clicks on to a thin, rigid rail which is transverse to the piano keys and mounted, either in a single piece or in sectional pieces, above the hammer shanks just in front of the hammer. This rail (or rails) is adjustable for height (and optionally, also front-to back) and is set so that, at the highest point in their travel, the hammer shanks cannot quite touch it (them). The sensor is positioned mainly at the rear (or hammer side) of the rail, and may be held by a variety of means to it. The fin transducer containing the position information about the hammer is preferably made as one piece including the spring-clip holding it to the hammer shank. The fin may be specially bent or incorporate transverse edge ribs for rigidity.

When used in an upright piano, fins may be attached to either shanks or hammers, and sensor rails, which may possibly in this case include electronics, may be mounted on edge from suitable brackets, adjustable front-to-back as well as vertically.

Individual damper or key motion, for example, may be sensed by optical sensors reading a small single or dual, opaque or translucent, bar-code-type flag of even percentage bars similar to that used on the hammers. This flag may be attached to any part of the damper mechanism or if preferred, to the piano key, affording space for it and the sensors reading it. On upright pianos, where the damper mechanism is surrounded by machinery and space may not be available, the damper flag-and-sensor assembly may be attached to the front of the whippen, or if necessary, to the key. In any case, the sensors may be attached to rails similar or identical to those used to support the hammer sensors, using the readily adjustable clip feature disclosed in detail below. Fiber optics may be used as desired to read the damper or key flag and convey this information to the optical sensors. Information about damper or key motion may be read in any of the same ways as hammer information is read, and the same methods of interpreting the information may be used. However, in the case of dampers, only the moment of damper lift and moment of contact with the string during descent need be learned inasmuch as knowing the velocity in this case is unimportant, since it is impossible to reproduce individual damper motion without reproducing key motion, which is being done anyway for the more urgent purpose of controlling the hammer. If desired, the moment of individual damper lift may be extrapolated from hammer motion, and the damper sensors may be used only to gather data about whether the damper was activated (whether the blow was staccato) and about the time of damper contact with the string during descent.

The so-called "bar code" principles (100% contrast bars) described above may be applied also to the reading of pedal motion, and a bar-scale may be attached to the damper lift tray, to the pedal linkage, to the keyframe (for keyframe shift), to the hammer-rail in an upright or grand piano, or to any other device in any musical instrument about whose motion and position it is desired to gather information. Either the bar-scale or the sensor may be attached to the moving part, and the other component, whether bar-scale or sensor, may be attached to the stationary part against which the motion of the moving part is to be compared.

The motion-sensing scheme summarized has many other possible applications, such as in accurately recording the bowing of a violin or of other stringed instruments. An immediate application is in enabling ordinary acoustic pianos to function as MIDI keyboards by sending information out from a piano keyboard which can be read and interpreted by standard MIDI software. The subject sensing system, while simple to install, is far more accurate than devices currently on the market for this purpose which record and extrapolate only from the motion of the piano key as it is played, or which do not index velocity and position calculations to the instant of reversal of the part in question.

DESCRIPTION OF THE DRAWINGS

The subject matter of the invention is particularly pointed out and distinctly claimed in concluding portion of the specification. The invention, however, both as to organization and method of operation, may best be understood by reference to the following description taken in conjunction with the subjoined claims and the accompanying drawing of which:

FIG. 1 is a cross sectional view of a grand piano action, with much of the escapement omitted for clarity, illustrating the manner in which a fin position indicator component is carried by a hammer shank;

FIG. 3 is a view taken in the region—3—of FIG. 1 particularly illustrating the relationship of a pair of optical bands incorporated into the fin component;

FIG. 4 is a partial cross sectional view taken along the lines 4—4 of FIG. 1 and showing certain important aspects of the fin construction;

DETAILED DESCRIPTION OF THE PREFERRED EMBODIMENT(S)

Figure 2:
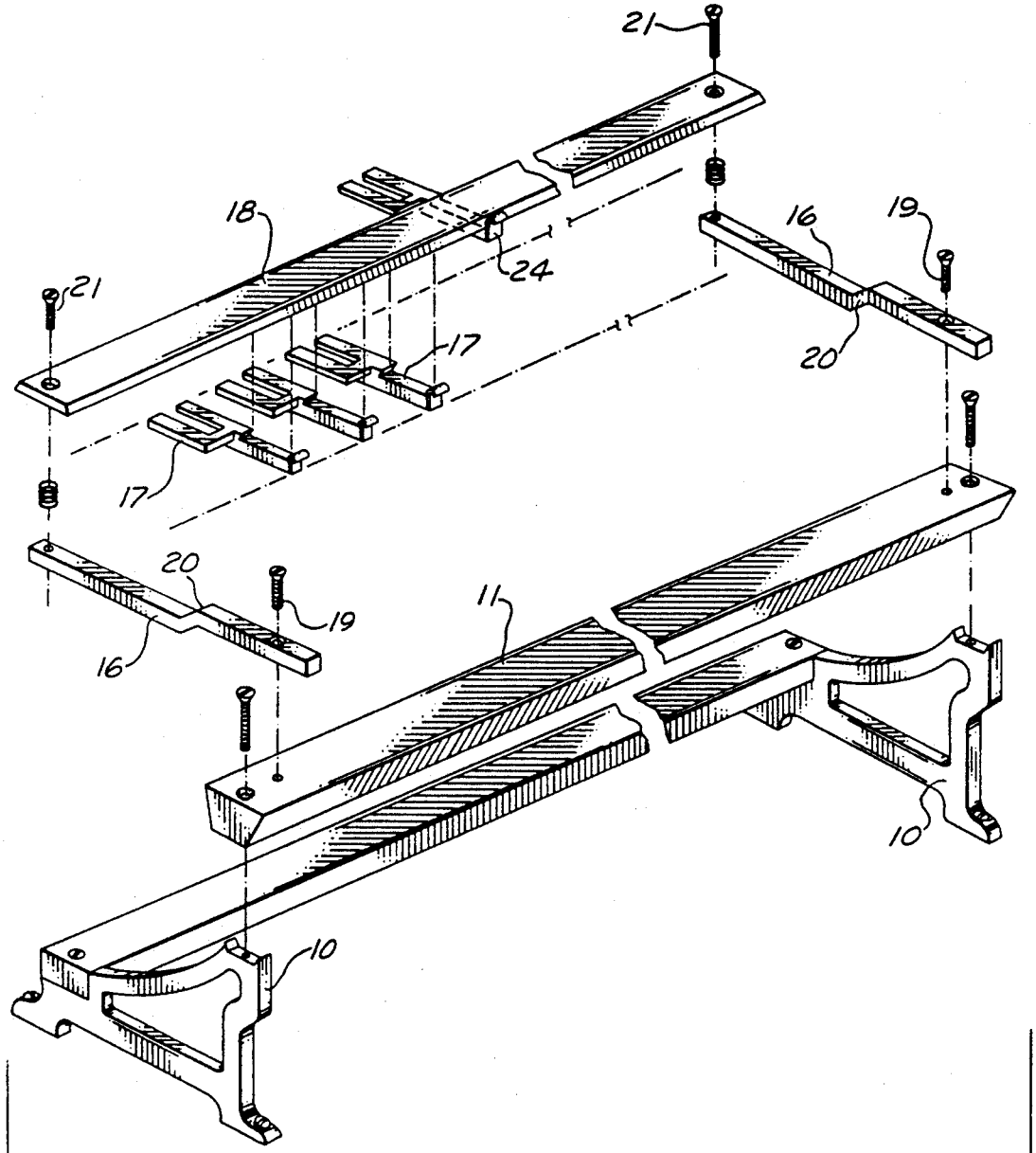
FIG. 2 is an exploded view showing the support structure for the sensor assemblies associated with each hammer of the action.

In order to disclose the invention in a manner which will fully teach it to those skilled in the art, the most common application, that of tracking the travel of a grand piano hammer, has been selected.

Thus, referring now to FIG. 1, there is shown a cross section of a grand piano action with much of the escapement structure omitted for clarity in explaining the subject invention. Thus, an action bracket 10 supports a hammer rail 11 to which each hammershank flange 12 is fastened by an individual screw in the well known manner. A hammershank 13 is pivotally fixed to the hammershank flange 12 and carries the hammer 14 at its free end. A hammer rest 15 defines the rest position of the hammer assembly. When actuated through the escapement (not shown), the hammer swings upwardly in an arc to strike the string, all as well known to those skilled in the art.

Referring also to FIG. 2, the support structure for sensor assemblies 17 to be described below is shown. A series of sensor rail brackets 16 are provided to afford cantilever support for the sensor rail. The sensor rail brackets 16 may be emplaced at the section break positions and at the ends of the action by screws 19 which are longer than those normally found at those positions. In FIG. 2, only the end sensor rail brackets 16 are shown; those skilled in the art will understand that, in a four "break" action, there will be three additional sensor rail brackets spaced intermediate the end ones shown to provide rigid, cantilevered support for a transverse sensor rail 18.

Figure 5:
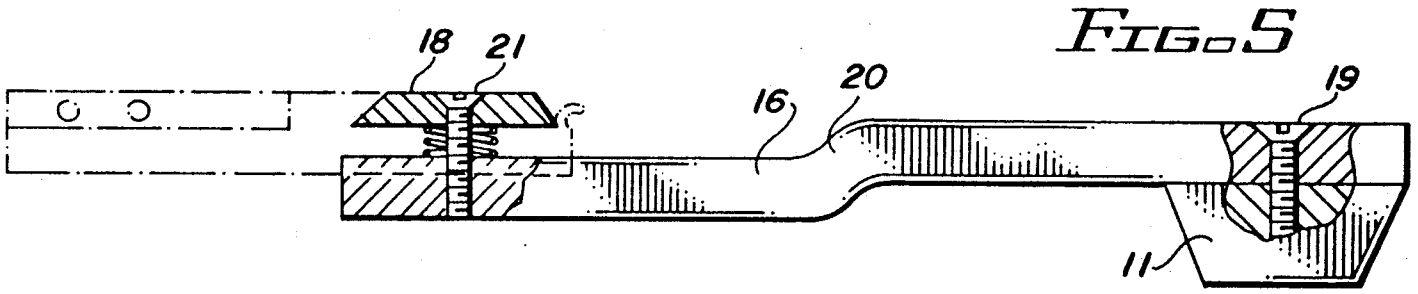
FIG. 5 is a partially broken away view showing a height adjustment for a sensor rail component of the sensor assembly.

Referring to FIGS. 2 and 5, it will be seen that the sensor rail brackets 16 preferably incorporate a step-down region 20 to obtain vertical clearance. The sensor rail 18 is coupled to the several sensor rail brackets 16 near their outboard ends by screws 21. In order to obtain fine vertical adjustment of the sensor rail 18, compression springs 22 are provided around each screw 21 between the lower surface of the sensor rail 18 and the upper surface of the sensor rail brackets 16. It will be observed that the cross section of the sensor rail 18 is trapezoidal with the upper parallel surface being narrower in cross section than the lower parallel surface. This feature permits ready coupling of the sensor assemblies 17 to the sensor rail as will become more apparent below.

Figure 7:
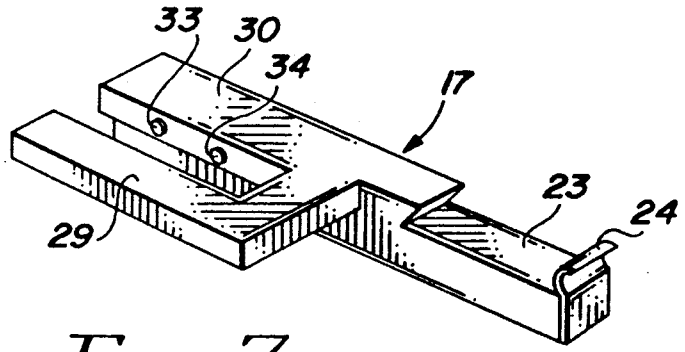
FIG. 7 is a second, reversed, perspective view of the sensor carrier.
Figure 6:
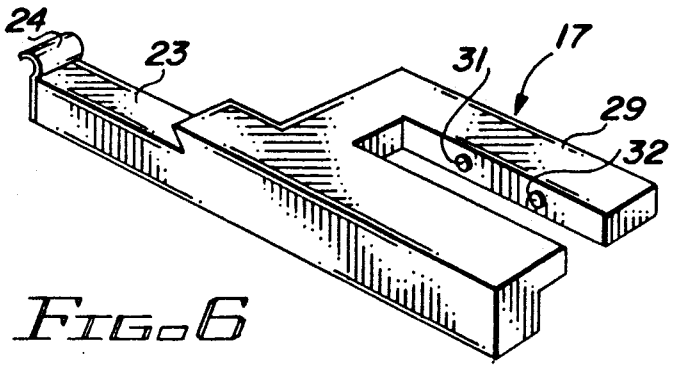
FIG. 6 is a first perspective view of a sensor carrier component of the sensor assembly.

Referring now to FIGS. 6 and 7 as well as FIGS. 2 and 5, it will be seen that each sensor assembly 17 incorporates a recess 23 which is complementary in shape to the cross section of the sensor rail 18 and which employs a resilient spring clip 24. Thus, each sensor assembly 17 may be fastened rigidly and at the desired position by simply snapping it into place onto the sensor rail 18 from beneath as illustrated by the single emplaced sensor assembly in FIG. 2.

Attention is now directed to FIGS. 1, 3, and 4 by which an understanding of the structure of a fin transducer 25 component attached to each hammer shank 13 may be understood. Each fin 25 is affixed to its associated hammer shank 13 just inboard from the hammer 14 and is oriented generally vertically. The lower end of the fin 25 preferably incorporates a spring clip 26 which is arcuate in cross section and exceeds a half circle. The dimension of the spring clip 26 is selected such that it can be securely snapped over and frictionally engage the circular cross section (at that point) of hammer shank 13 to support the fin 25 at the desired position and in the correct orientation. A drop of glue may optionally be applied to the clip to permanently secure it to the hammer shank, once correct adjustment of the clip has been achieved. If the fin 25 is not found to be sufficiently rigid to maintain its planar character, small transverse ribs or other stiffening means may be incorporated.

As best shown in FIG. 3, the fin 25 carries two side by side bands 27, 28, each including vertically alternating clear and opaque (or reflective and non-reflective) evenly spaced bars. It will be particularly noted that the bars in the two bands 27, 28 are slightly staggered with respect to one another which is one key feature of the invention which will be explained in detail below.

Figure 8:
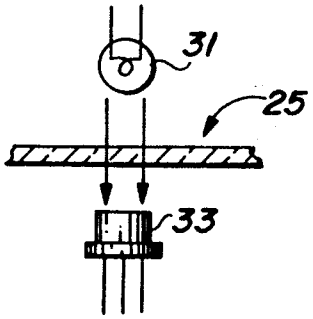
FIG. 8 is an illustration of a transmissive fin embodiment of the invention and its associated optical components.

Referring particularly to FIG. 4, to FIG. 8 and also again to FIGS. 6 and 7, it will be understood that each fin travels vertically, up and down, through an individual sensor assembly 17 in order that the sensor assembly can sense the bars as they go by during a hammer stroke. It will be noted that each sensor assembly 17 includes two arms 29, 30 which carry, respectively, facing pairs of light sources 31, 32 and light sensors 33, 34 for reading the bands 27, 28. Thus, referring particularly to FIG. 8, when a translucent or transparent bar is intermediate the light source 31 and the light sensor 33, the light sensor will issue a logic level signal, for example, a logic "1". Conversely, when an opaque bar is intermediate the light source 31 and the light sensor 33, the light sensor will issue the alternative logic level signal, i.e., a logic "0." As will become more apparent below, it is the transitions between translucent and opaque and the resulting switches in logic level output which may be readily utilized to obtain position, direction and speed information about a given hammer stroke.

Figure 9:
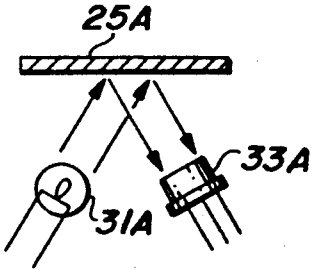
FIG. 9 is an illustration of an alternative reflective fin embodiment of the invention and its associated optical components.

Those skilled in the art of optical sensing will understand that, as shown in FIG. 9, the alternating translucent and opaque bars in a band may be equivalently replaced by alternating reflective and non-reflective bars in a variant fin 25A and the light source 31A and light sensor 33A placed adjacent one another on the same side of the fin to sense the bars as they traverse nearby. Such an arrangement has the advantage of requiring a sensor assembly 17 having only one arm and thus narrower and easier to fabricate.

Another contemplated varient is the use of a single traveling band containing a single scale of bars monitored by a sensing unit in which the staggering feature is achieved by employing two light sensors spaced apart along the direction of travel. Such modular dual sensing units (which include some of the requisite circuitry) are commercially available from, for example, Honeywell, Inc.

Still another contemplated variant is the use of magnetic sensing rather than optical sensing. If the bars 27, 28 are alternately magnetic and non-magnetic in character, then a simple magnetic sensor, such as a Hall-effect device, may be employed at 33, 34 to sense the transitions. This variant eliminates the need to have a light source and thus decreases the wiring requirements of the system; however, the electronics circuitry required are somewhat more complex although appropriate integrated Hall-effect sensors are commercially available from, for example, Sprague Electric Company.

Figure 10:
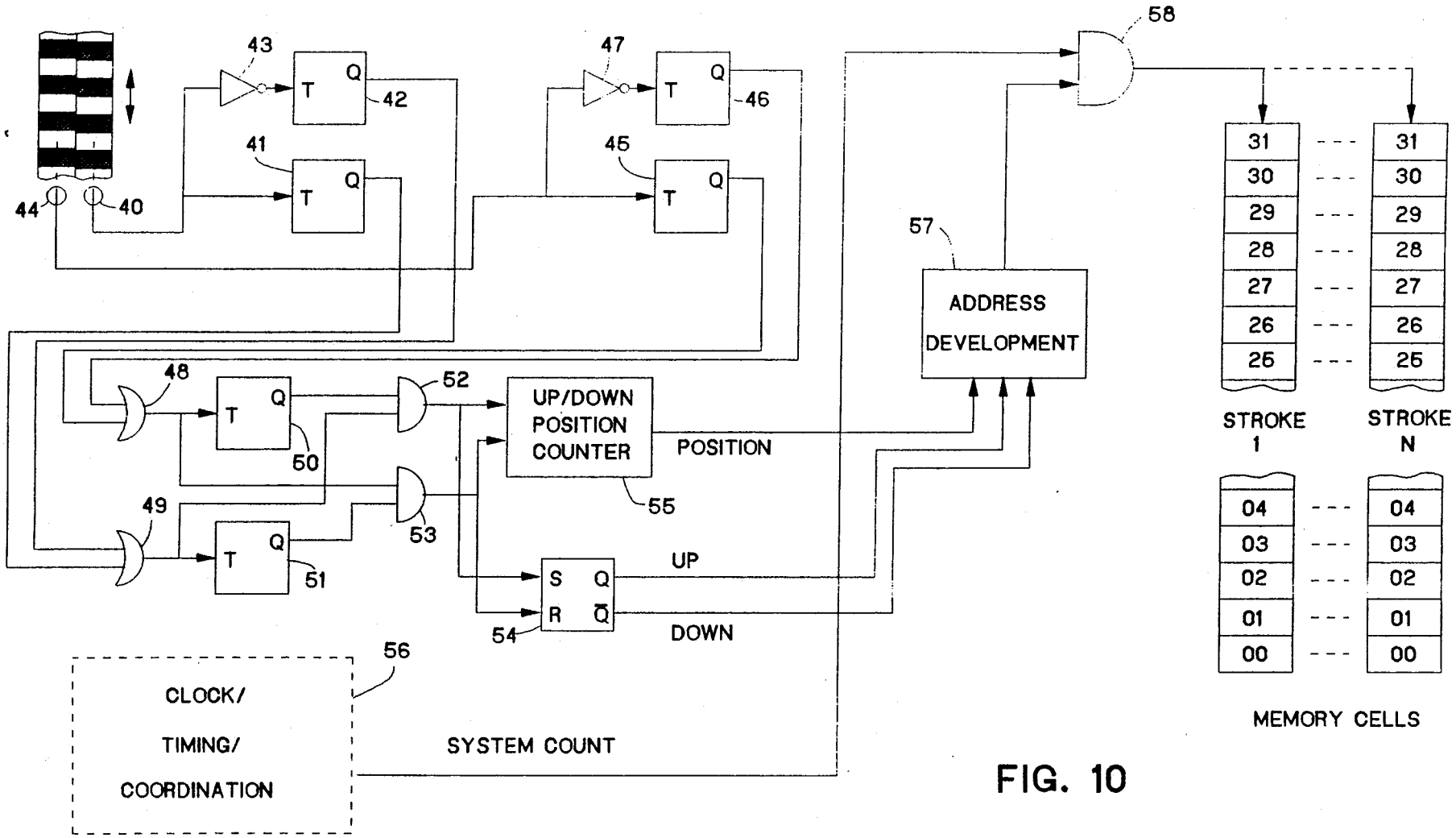
FIG. 10 is a logic diagram illustrating an exemplary circuit for utilizing the information obtained from the system optical components and FIG. 11 is a logic diagram illustrating an exemplary analog embodyment of the invention.

Referring now to FIG. 10, an exemplary digital logic circuit for utilizing the bars carried by the fin 25 to obtain hammer position, direction and speed information is shown. In this implementation, the sensors 44 and 44 (corresponding to the sensors 33, 34 previously mentioned) respond to the presence of a clear (or reflective or magnetic) bar by issuing a logic "1" and to the presence of an opaque (or non-reflective or non-magnetic) bar by issuing a logic "0". The sensor 40 reading the position band 28 drives a first one-shot flipflop 41 directly and a second one-shot 42 through an inverter 43. Thus, a transition in the position band 28 from opaque to clear will trigger the one-shot 41 whereas a transition from clear to opaque will trigger the one-shot 42. The lengths of the output pulses appearing at the Q outputs of the one-shots 41, 42, are selected to be quite short (in the context of this system) and, in any event, less than the time difference between the transitions observed at the position band 28 and at the direction band 27 of the fin 25 under any conditions realizable in the system. Similarly, the sensor 44 reading the direction band 27 drives one-shot 45 directly and one-shot 46 through inverter 47 such that either type of transition in the direction band is sensed. The output pulses from the one-shots 41, 42, 45, 46 are merely used as triggers for the succeeding stages, and those skilled in the art will understand that simple differentiator circuits will serve in place of the one-shots in many, if not all, instances.

The Q outputs from each of the one-shots 41, 42 are coupled to inputs to an OR-gate 49 which therefore is enabled to trigger a one-shot 51 for every transition sensed in the position band 28. Similarly, the Q outputs from each of the one-shots 45, 46 are coupled to inputs to an OR-gate 48 which therefore is enabled to trigger a one-shot 50 for every transition sensed in the direction band 27. The timeout periods of the one-shots 50, 51 are selected to be longer than that of the one-shots 41, 42, 45, 46 and, more particularly, more than the time difference between the transitions observed between the transitions observed at the position band 25 and at the direction band 27 of the fin 25 under any conditions realizable in the system.

The output of the OR-gate 49 is also coupled to one input of an AND-gate 52, the other input to which is driven by the Q output of the one-shot 50. Similarly, the output of the OR-gate 48 is also coupled to one input of an AND-gate 53, the other input to which is driven by the Q output of the one-shot 51.

Consider now the operation if the fin 25 is moving upwardly. The first transition sensed is in the direction of band 27 which causes the one-shot 50 to be triggered. Its Q output remains at logic "1" for a time sufficient for the trailing transition in the position band 28 to take place. At this instant, the AND-gate 52 is fully enabled to indicate upward travel of the fin 25. This information is latched into flip-flop 54 which is set (or remains set) such that its Q output is a logic "1" providing the UP signal. Conversely, consider the operation if the fin 25 is moving downwardly. The first transition sensed is in the position band 28 which causes the one-shot 51 to be triggered. Its Q output remains at logic "1" for a time sufficient for the trailing transition in the direction band 27 to take place. At this instant, the AND-gate 53 is fully enabled to indicate downward travel of the fin 25. This information is latched into flip-flop 54 which is reset (or remains reset) such that its Q-bar output is a logic "1" providing the DOWN signal.

The outputs from the AND-gates 52, 53 are also applied to an up/down position counter 55 which tracks the transitions as the fin 25 moves upwardly and downwardly. Thus, the instantaneous count in the counter 55 provides the hammer position information. This information is supplied to an address development block 57 which also receives the UP and DOWN signals as will be described further below.

System clock/timing coordination block 56 supplies a system count which is reflective of either the elapsed time in a given performance, or in an upward or downward stroke of the hammer, in the event that an interruption of the light beam after a certain period of non-interruption or the occurrence of a reversal of direction (phase change) are chosen as events which will start or stop the clock. The constantly incrementing system count is supplied to an AND-gate array and support circuitry 58 which also receives information from the address development block 57 in order to steer the instantaneous system count into a selected memory cell.

Assume, for purposes of illustration, that there are thirty-two transitions (a power of two is appropriate, but not fundamentally necessary) for the full travel of the position band 28 of the fin 25. During a hammer stroke starting from rest, the up/down counter 55 will count from 00 to up to, but possibly less than, 31; i.e., string impact may take place at, say, count 29 whereupon a reversal of travel takes place. This position information, along with the UP and DOWN signals, provides the address development block with sufficient information to steer the instantaneous system count into the appropriate cell of the thirty-two memory positions which records the system count for the represented hammer position. (If desired, of course, the downward hammer information can also be recorded.) Repetitive notes for which the hammer is not brought to rest are correctly recorded since the new upward hammer travel instituted before the hammer falls to its rest position is sensed and interpreted as a new stroke on this note such that a new block of memory cells receives the system count.

The information collected and stored by this system can be utilized not only to obtain an essentially perfect playback, but also to secure modeling information by which a somewhat simpler system may be realized. For example, while it may be desirable to collect all the hammer flight information in a laboratory instrument, a home instrument may need only to record stroke institution and let off speed and time information to achieve superb reproduction.

The circuitry of FIG. 10, of course, is only representative of many approaches to utilizing the information obtained from my data collection system.

Another way of utilizing the subject optical or magnetic sensor configuration is to read the motion of dual, wave- or sawtooth-shaped lines (as opposed to the parallel bars discussed above), as a changing frequency while they travel past dual sensors. In this analog arrangement the frequency changes with the velocity at which the figures on the scale travel past the sensors. Also, the phase of the frequency changes as the direction changes. Therefore, not only does phase change reveal direction of the hammer and the exact instant of strike, but also, the frequency detected at the precise moment of phase change equals the velocity of the scale's motion at the instant of strike. This comparative value can then be assigned a digital equivalent for use in the playback program. Alternatively, a single-figured flag may be used, and the instant noted at which the tone read by the sensor briefly ceases during reversal of direction. However, this approach may allow errors of the type referred to earlier.

Figure 11:
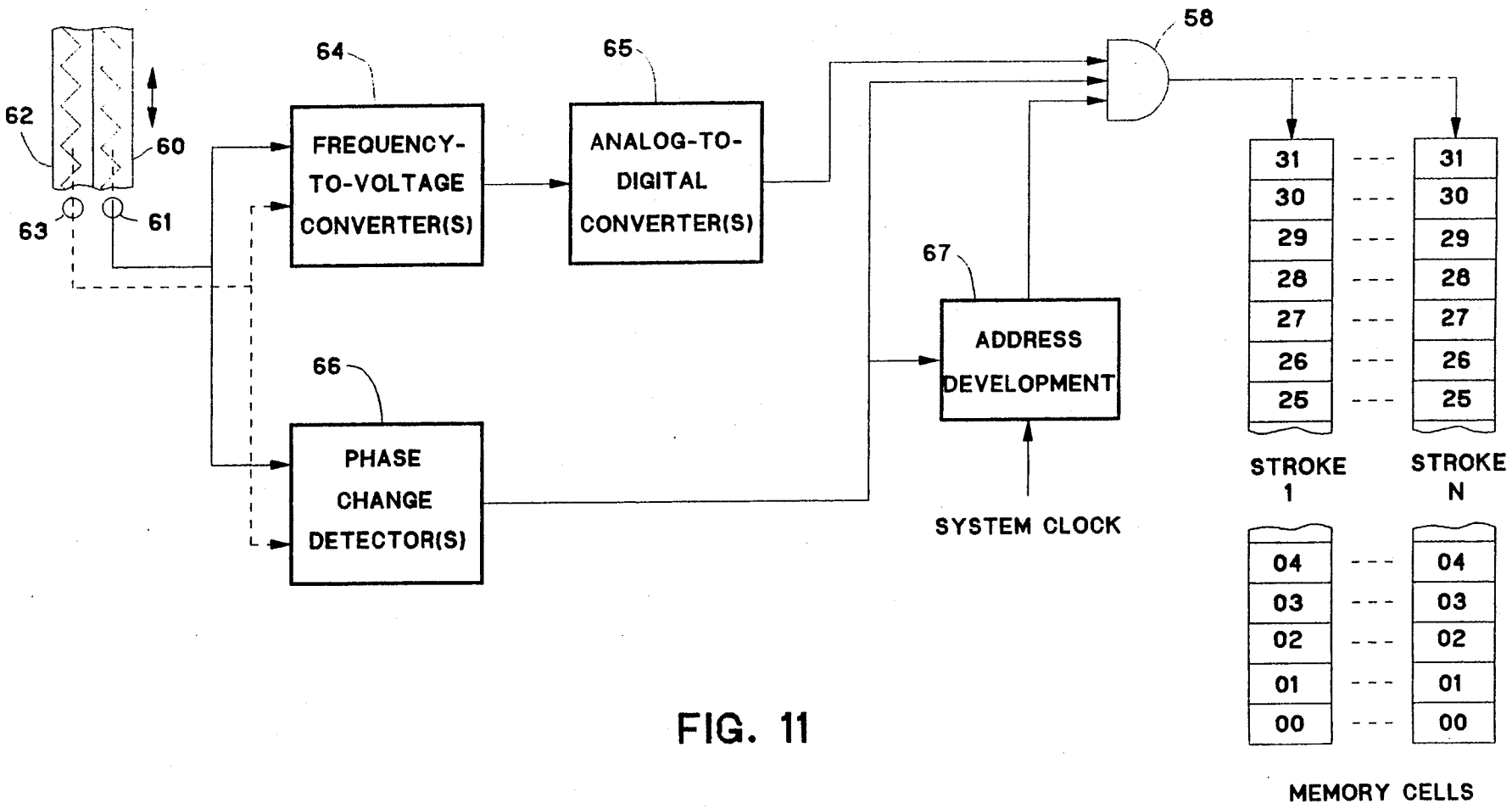

FIG. 11 shows an exemplary implementation of an analog embodiment of the invention. The indicia carried by the bands 60, 62 are shown for simplicity as triangular waves skewed vertically to obtain a phase difference as they are read, respectively, by sensors 61, 63. (In practice, the indicia may typically be sine waves or sinusoidally varying degrees of opaqueness.) Alternatively, a single band 60 and single sensor 61 may be employed although less information is obtainable thereby.

Speed information may be obtained by applying the output of sensor 61 (and also sensor 63 if two channels are used) to frequency-to-voltage converter block 64. Those skilled in the art will understand that the voltage output from frequency-to-voltage converter block 64 at a given instant is a voltage proportional or otherwise analogous to the instantaneous rate at which the band 60 is moving past the sensor 61. This instantaneous voltage, in turn, may be digitized by analog-to-digital converter 65 to provide instantaneous speed information which can be stored into the memory cells under control of the system clock and the address development block 67 in much the same manner as described for the all-digital system of FIG. 10. The system clock may be employed to select the incremental points in time at which the analog-to-digital conversion takes place to obtain a series of numbers representing the speed of the moving element through as series of incremental positions during its travel as during a hammer stroke.

Similarly, phase reversal (as when a string has been struck and the hammer reverses direction) can be sensed by phase change detector block 66 and stored in the memory cells under control of the system clock and address development block. In addition, if both bands 60 and 62 are employed, the phase change detector block 66 can relate which phase from which band is leading at a given instant to obtain instantaneous direction information.

While the foregoing discussion has been directed to the example of tracking the position, direction and speed of a moving piano hammer, those skilled in the art will appreciate that the equivalent information for each of the pedals should also be tracked and recorded and that the methods and structures discussed above can be readily adapted to achieve this aim. Further, the principles of the invention may be employed in faithfully recording performances of other musical instruments in which the instant of tone attack (and, if necessary, the speed and direction of the attacking component) are essential elements of the performance. Merely by way of further example, the relevant information for the keyboards, pedals and control settings of an organ may be collected to obtain the data required for reproducing a performance, instead of the current methods either on the Stahnke pattern or of the key-motion sensing type. Both may be changed to direction-reversal- or other-based systems of motion sensing described above, with the consequent improvements in accuracy and self-calibration described above.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. A system for tracking the speed, direction and position of a piano hammer comprising:

A) a fin element coupled to said piano hammer carried by a hammer shank for travel therewith, said fin element incorporating machine readable indicia along its length, said indicia comprising at least one band of alternating bars of first and second character, said alternating bars being evenly spaced and extending in the direction of travel of said hammer;

B) a motion sensing sensor assembly positioned to read said indicia as said fin element travels with said hammer to thereby detect information about the time said hammer has been in motion following a keystroke and about the instantaneous direction and position of said hammer following said keystroke at a plurality of positions along its path intermediate a first reference position at which said hammer is at rest and a second reference position at which said hammer strikes a string; and C) recording means to record said time, direction and position information.

2. The system of claim 1 in which said machine readable indicia comprises alternate translucent and opaque bars and in which said motion sensor assembly comprises at least one light source and at least two light sensors placed on opposite sides of said fin element.

3. The system of claim 2 in which said machine readable indicia incorporated in said fin element comprises two bands carrying duplicate indicia offset from one another in the direction of travel of said piano hammer and which includes a light sensor for each said band.

4. The system of claim 3 in which said fin element is affixed to the hammer shank carrying said hammer.

5. The system of claim 2 in which said light sensor includes a pair of light sensing elements spaced apart along the direction of travel of said fin element.

6. The system of claim 5 in which said fin element is affixed to the hammer shank carrying said hammer.

7. The system of claim 2 in which said fin element is affixed to the hammer shank carrying said hammer.

8. The system of claim 7 in which said machine readable indicia comprise alternate reflective and non-reflective bars and in which said motion sensor assembly comprises at least one light source and at least one light sensor placed on one side of said fin element.

9. The system of claim 8 in which said machine readable indicia incorporated in said fin element comprises two bands carrying duplicate indicia offset from one another in the direction of travel of said piano hammer and which includes a light sensor for each said band.

10. The system of claim 9 in which said fin element is affixed to the hammer shank carrying said hammer.

11. The system of claim 8 in which said light sensor includes a pair of light sensing elements spaced apart along the direction of travel of said fin element.

12. The system of claim 11 in which said fin element is affixed to the hammer shank carrying said hammer.

13. The system of claim 8 in which said fin element is affixed to the hammer shank carrying said hammer.

14. The system of claim 13 in which said machine readable indicia comprises alternate magnetic and non-magnetic bars and in which said motion sensor assembly comprises at least one magnetic sensor placed adjacent said fin element.

15. The system of claim 14 in which said fin element is affixed to the hammer shank carrying said hammer.

16. The system of claim 1 in which said machine readable indicia incorporated in said fin element comprises two bands carrying duplicate indicia offset from one another in the direction of travel of said piano hammer.

17. The system of claim 16 in which said fin element is affixed to the hammer shank carrying said hammer.

18. The system of claim 1 in which said fin element is affixed to the hammer shank carrying said hammer.

* * * * *